United States Patent [19]

Lovgren

[11] Patent Number: 4,840,002

[45] Date of Patent: Jun. 20, 1989

[54] SYSTEM FOR INSTALLING WOOD DOOR JAMBS AND HARDWOOD DOOR TRIM

[76] Inventor: Einar Lovgren, 3011 Linton Blvd., #203-D, Delray Beach, Fla. 33445

[21] Appl. No.: 50,304

[22] Filed: May 14, 1987

[51] Int. Cl.[4] ..... E06B 1/04

[52] U.S. Cl. ..... 52/213; 52/211

[58] Field of Search ..... 52/281, 290, 295, 718, 52/211

[56] References Cited

U.S. PATENT DOCUMENTS

| | | | |
|---|---|---|---|
| 1,599,985 | 9/1926 | Carlsson | 52/213 X |
| 2,237,777 | 4/1941 | Birson | 52/213 X |
| 3,189,137 | 6/1965 | Harris | 52/213 X |
| 3,210,898 | 10/1965 | Kurtz | 52/281 |
| 3,226,781 | 1/1966 | Schnabel | 52/213 X |
| 3,338,008 | 8/1907 | Sklar | 52/211 |
| 3,741,068 | 6/1973 | Andruskiewicz | 52/213 X |
| 4,443,984 | 4/1984 | Rasmussen | 52/211 X |
| 4,509,294 | 4/1985 | Boilard | 52/211 X |

*Primary Examiner*—David A. Scherbel
*Assistant Examiner*—Creighton Smith
*Attorney, Agent, or Firm*—Steele, Gould & Fried

[57] ABSTRACT

A system is provided for particularly installing wood door jambs to metal studded wall door openings and for mounting hardwood trim to the jambs and walls. The system includes a clip with structure adapted to engage wall structure to secure the clip to the wall. The clip further includes engagement structure adapted to engage cooperating engagement structure on the back face of vertical hardwood door trim. The hardwood trim is easily mounted without the necessity of pre-drilling holes through the hardwood trim and damaging the natural wood beauty of the visible front face. the clip also includes structure for engaging a door jamb member so that the door jamb may be secured to the door frame. A method for mounting hardwood trim and a door jamb is also provided.

17 Claims, 7 Drawing Sheets

SYSTEM FOR INSTALLING WOOD DOOR JAMBS AND HARDWOOD DOOR TRIM

BACKGROUND OF THE INVENTION

1. Field of the Invention

This invention relates generally to mounting structure, and more particularly to structure for installing wood door jambs to metal studded wall door openings, and for mounting hardwood trim to the door jamb and surrounding wall.

2. Description of the Prior Art

Hardwood trim is desired for both its beauty and its durability. Hardwood trim is difficult to install when metal studs, rather than wood studs are used to construct interior walls. Hardwood trim must be installed by using special screws rather than conventional nails. The inherent hardness of hardwoods makes it imperative to pre-drill holes which are large enough to receive screws to prevent costly cracking or breaking. The holes must be drilled through the hardwood trim to receive the screws. The screws shall be countersunk and subsequently covered with colored putty in an attempt to hide the screw heads. The putty used to cover the screw heads is difficult to match with the color of the hardwood and cannot simulate the grain of the wood. This requires another time consuming operation and the screw holes, though covered, remain quite visible and detract from the natural beauty of hardwood.

Door jambs typically are installed as a U-shaped structural unit assembly with pre-hung doors. The assembly is held in place in the door opening by the installer who then must attempt to plumb the jamb with a level and to fix the jamb in place with nails or the like. Tapered wood shims are usually used to fill the space between the door jamb and the door opening in the wall to retain the door jamb in the plumb position.

The common installation procedures presently being used, pre-drilling holes and countersinking screws, are tedious, time consuming and expensive. Mainly, this is due to the excessive amount of time required to perform the many needed operations on the construction site.

A number of devices have been used in the past to suspend a variety of articles from walls, ceilings, and the like. Representative patents include Poupitch, U.S. Pat. No. 2,584,813; Brown, U.S. Pat. No. 2,585,996; MacCallum, U.S. Pat. No. 3,004,643; Seckerson, U.S. Pat. No. 3,208,119; Rantala, U.S. Pat. No. 4,180,957; Tenaka, et al, U.S. Pat. No. 4,349,993; Anderson, U.S. Pat. No. 4,452,021, and Weinar, U.S. Pat. No. 4,569,172.

SUMMARY OF THE INVENTION

It is an object of the invention to provide a system for mounting hardwood trim that does not require pre-drilling the trim.

It is another object of the invention to provide a system for mounting hardwood trim that does not require holes through the visible surface of the trim.

It is yet another object of the invention to provide a system for mounting wood door jambs that can be readily installed without a need for tapered shims.

It is still another object of the invention to provide a system for mounting hardwood trim in which door trim will be properly aligned coincidentally with the alignment of the door jamb.

It is another object of the invention to provide a system for mounting hardwood trim which will require substantially less labor to install than prior trim systems and methods.

These and other objects are accomplished by a system for mounting hardwood trim which includes a clip with structure to engage wall structure and a piece of vertical hardwood door trim so as to hold the hardwood trim securely to wall structure such as plasterboard or a wall stud. The clip further includes structure for engaging a door jamb. The clip preferably includes tongue structure adapted to engage a cooperating undercut portion in vertical hardwood door trim. The undercut portion is preferably a groove or pocket and is formed in a back face portion of the hardwood trim. Sliding movement of the hardwood trim and the undercut portion relative to the tongue structure will engage the hardwood trim to the tongue structure of the clip and thus to the wall structure. A front face portion of the hardwood trim is unaltered and thereby the beauty of the wood is retained.

The wall engagement structure of the clip preferably comprises a base portion adapted to abut the wall surface. The tongue structure is preferably raised from the base portion by leg flange structure so as to be suspended from the wall surface in substantially parallel alignment. The tongue structure preferably comprises substantially symmetrical tongue flanges provided at opposite sides of the base portion. The raised tongue flanges can be provided in half-circular shapes, with corrugations to provide additional strength.

The wall engagement structure can be provided as at least one aperture in the base portion adapted to receive suitable fastening structure such as a screw. The clip is preferably fixed through the plasterboard of a conventional metal studded wall to a metal stud.

The system according to the invention can be used to plumb the wood door jamb without a need for tapered wood shims. The clip preferably comprises a center spacing portion extending from the base portion and having door jamb engagement structure at an end distal to the base portion. The door jamb engagement structure preferably comprises a flange substantially perpendicular to the center spacing portion adapted to engage a bore in a side face of the door jamb. A channel is preferably formed in the door jamb from the bore to the back face of the jamb member such that the center spacing portion lies flush to the side face of the door jamb. The hardwood trim can then substantially abut the side face of the door jamb without interference from the center spacing portion. The door jamb engagement flange preferably has a sawtooth edge to firmly engage the door jamb.

Additional door jamb engagement structure can be provided. An aperture can be formed in the center spacing portion abutting the portion of the door jamb between the bore in the side face of the door jamb and the back face of the door jamb. The aperture can receive a screw or other suitable fastening structure to firmly engage the clip to the door jamb. The screw preferably would have a flat head to maintain a flush surface.

The center spacing portion is preferably substantially parallel to the base portion and offset therefrom a distance substantially that of the thickness of the base portion. Hardwood trim can thereby be substantially flush with the wall, at the back face of the base portion, and with the front face of the center spacing portion and thus the side face of the door jamb.

A stop portion is preferably provided on the center spacing portion. The stop portion comprises a surface substantially perpendicular to the center spacing portion and substantially parallel to the back face of the door jamb. The stop portion abuts the door jamb to provide rigidity and stiffness to the door jamb structure. The stop portion can be formed from laterally extending flanges on the center spacing portion that are partially turned at right angles to form the stop portions.

The undercut portion in the hardwood trim preferably comprises a bore in the back face of the hardwood trim substantially matching the perimeter of the raised tongue flanges of the clip. The hardwood trim is undercut at the base of the bore in at least one direction, to form a pocket into which a raised tongue flange can move. The bore is formed to a depth substantially equal to the distance from the back face of the base portion to the front face of the tongue flanges so that, when in place, the back face of the hardwood trim will rest substantially flush against the wall surface.

A method is provided to erect a door jamb and trim. A plurality of clips are secured to the vertical side faces of the door jamb. The door jamb assembly is plumbed within the door opening. The door jamb assembly is then secured in place by the application of structure on the clips for engaging the wall structure of a building. Door trim is then secured to the door jamb clips by securing an undercut portion at the back face of the door trim to tongue structure on the clips. Each vertical piece of door trim is interconnected to corresponding door jamb clips. The door trim is completed with top portions of door trim at the top of the door frame. The top portions of door trim are preferably interconnected to top edges of vertical door trim by corresponding tongue and groove portions.

BRIEF DESCRIPTION OF THE DRAWINGS

There are shown in the drawings embodiments which are presently preferred, it being understood, however, that the invention is not limited to the precise forms and arrangements shown, wherein.

DESCRIPTION OF THE PREFERRED EMBODIMENTS

Figure 1:
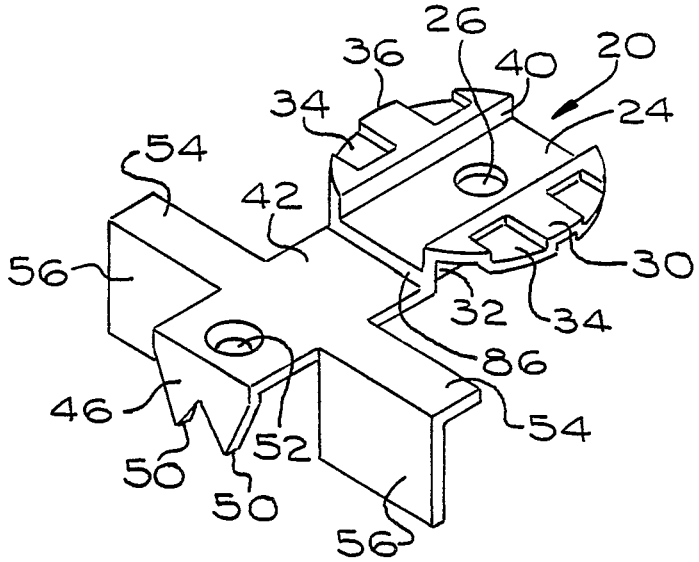
FIG. 1 is a perspective of a clip according to the invention including door jamb engagement structure.
Figure 6:
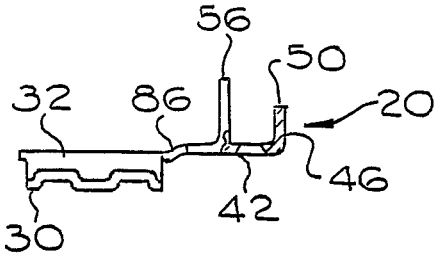
FIG. 6 is a rear elevation.
Figure 4:
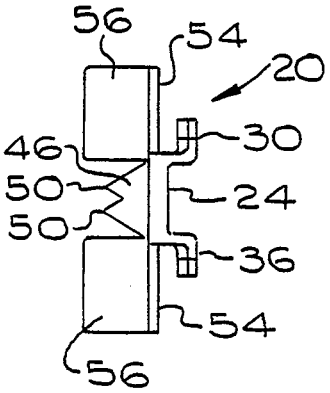
FIG. 4 is a left side elevation.
Figure 2:
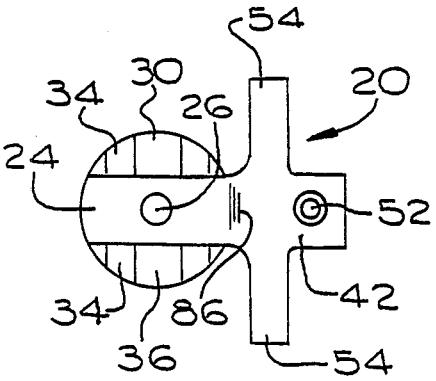
FIG. 2 is a plan view.
Figure 3:
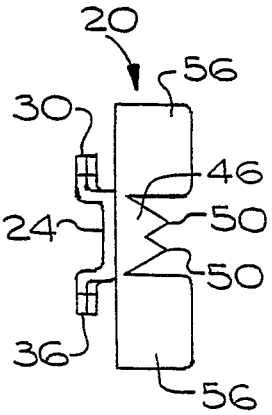
FIG. 3 is a right side elevation.
Figure 5:
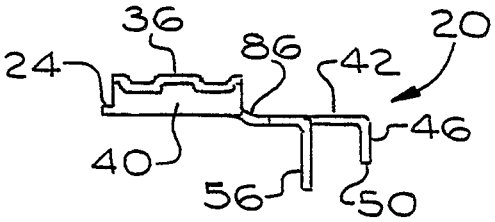
FIG. 5 is a front elevation.
Figure 7:
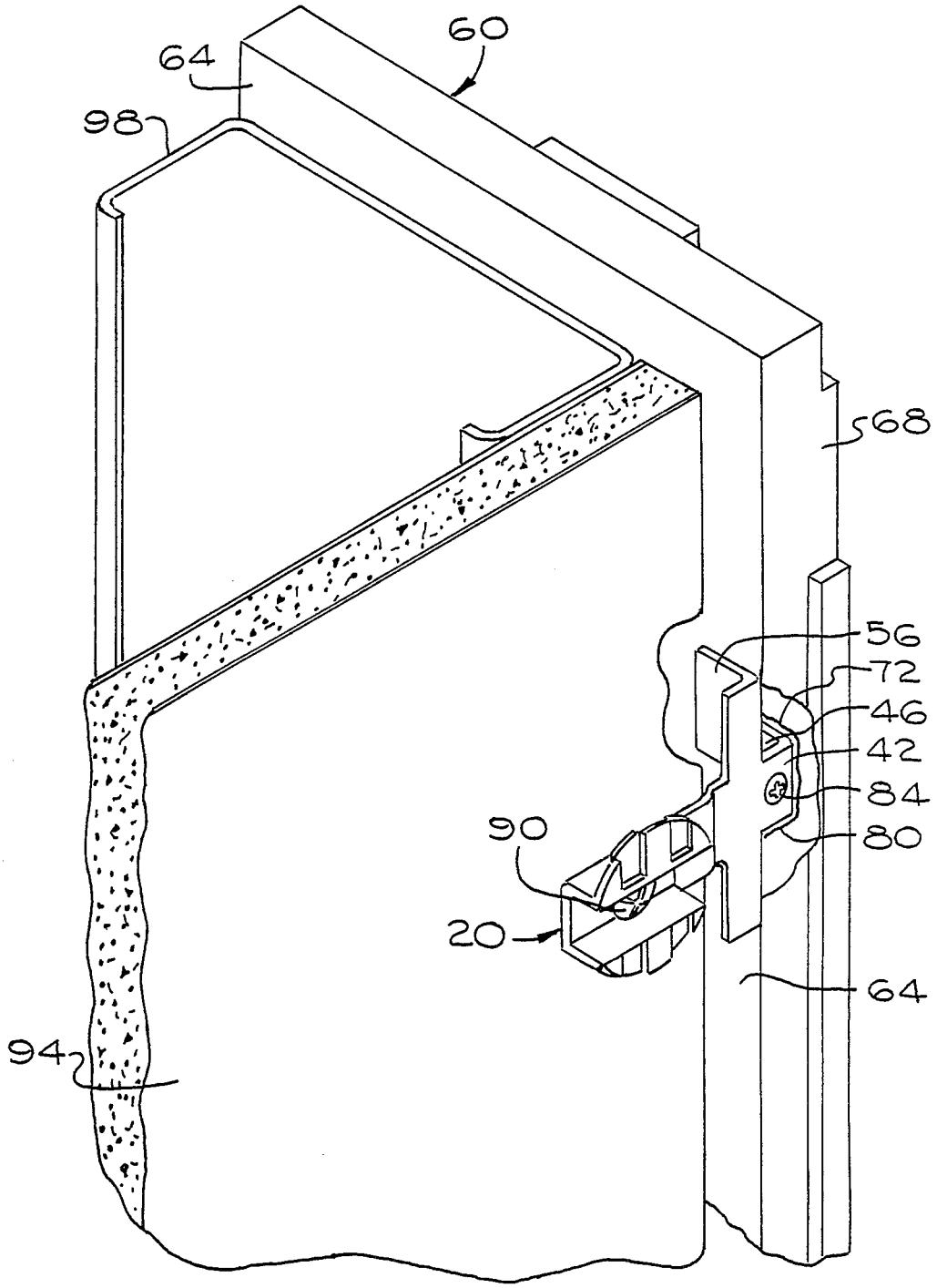
FIG. 7 is a perspective showing a clip according to the invention engaged to a door jamb and to building wall and frame structure.
Figure 9:
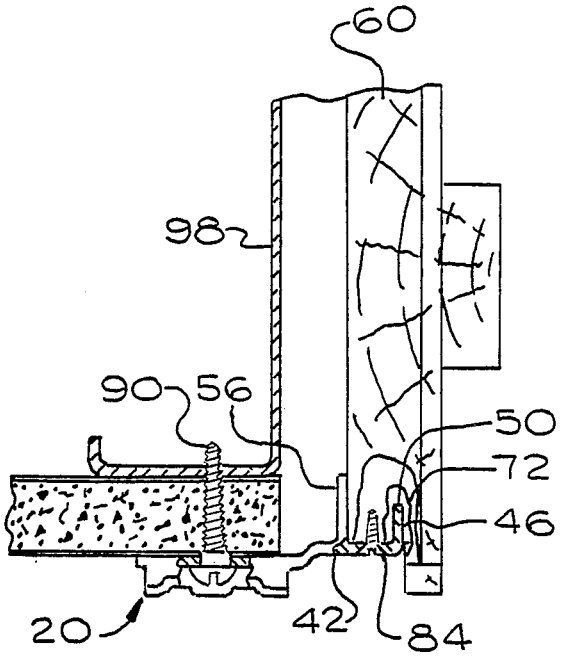
FIG. 9 is a cross-section taken along line 9—9 in FIG. 8.
Figure 8:
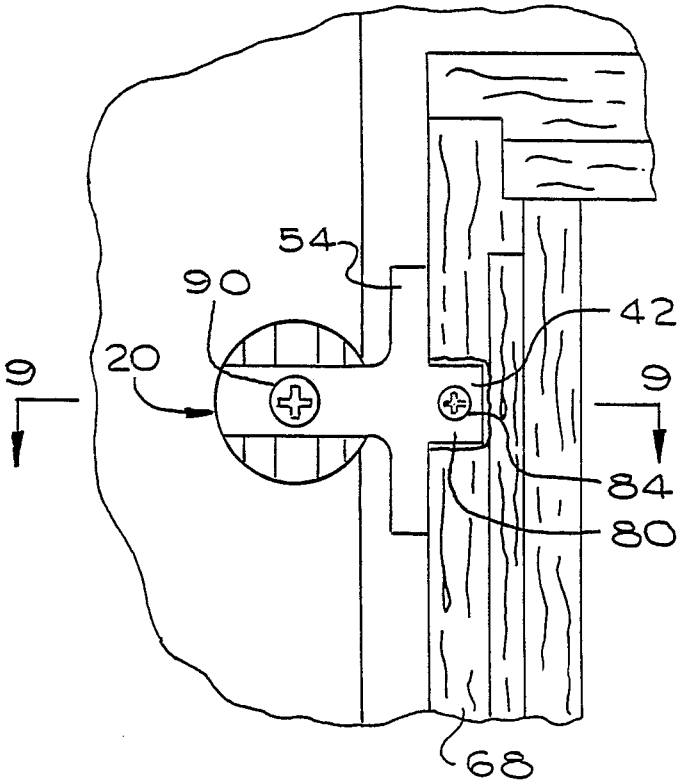
FIG. 8 is a front elevation showing a clip engaged to a door jamb and to building wall and frame structure.
Figure 10:
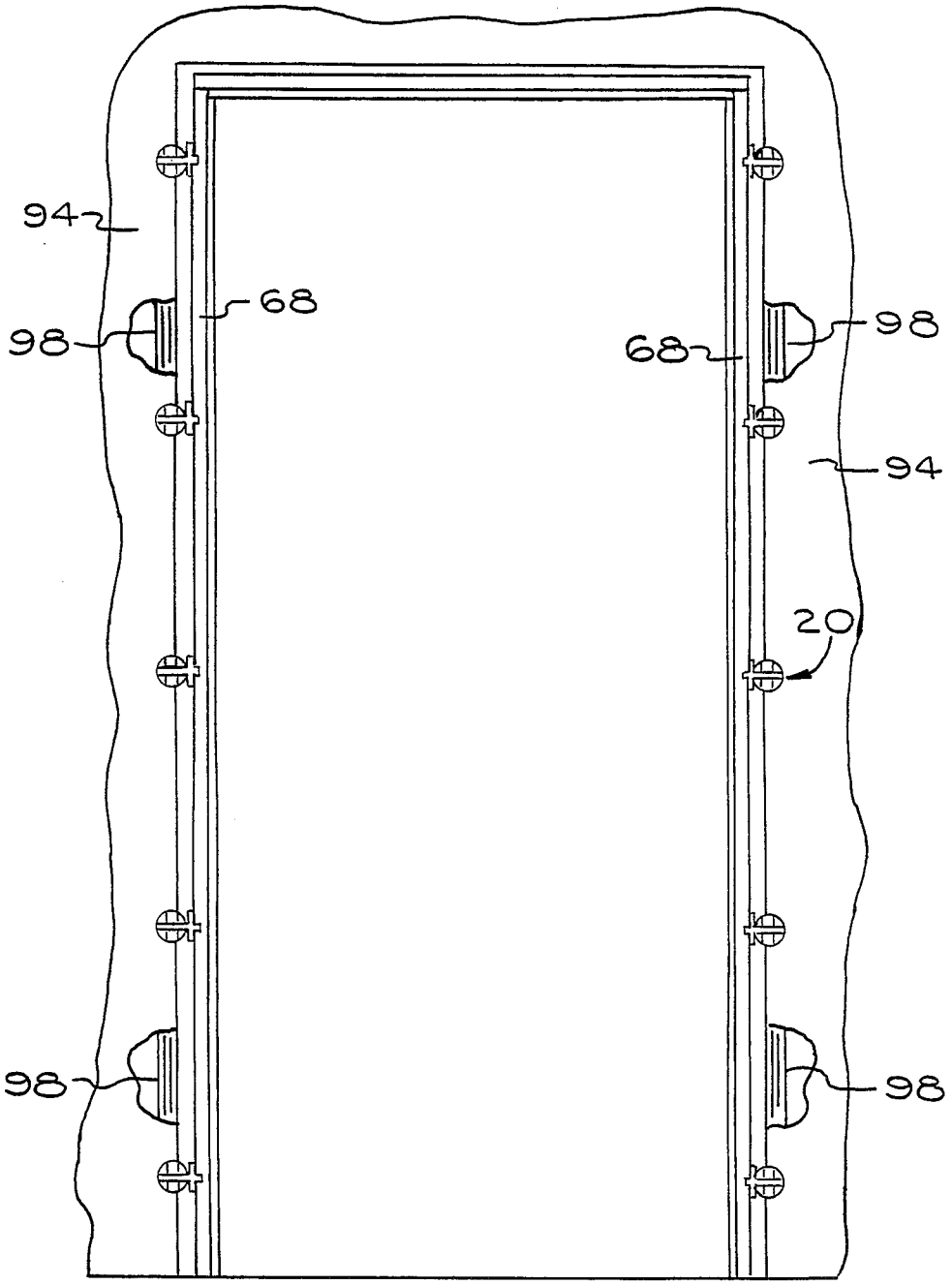
FIG. 10 is a front elevation, partially broken away, showing an installed door jamb assembly according to the system of the invention.

The invention provides a system for mounting hardwood trim that includes a clip with structure for engaging wall structure and structure for engaging the door jamb. Tongue structure is provided on the clip and is adapted to engage cooperating structure in a piece of hardwood trim. Referring to FIGS. 1–6, a clip 20 according to the invention includes a base portion 24 as structure for engaging wall structure such as plasterboard or a wall stud, and particularly a metal stud. The base portion 24 is preferably substantially planar to evenly abut the wall surface. An aperture 26 can be provided in the base portion to receive suitable fastening structure to secure the base portion to the wall structure. The clip 20 includes a tongue structure such as the tongue flange 30. The tongue flange 30 is adapted to engage cooperating undercut structure formed in pieces of hardwood trim to provide a secure joint without the necessity of drilling holes through the trim. The tongue flange 30 can be raised from the base portion 24 by a leg flange 32 that is fixed between the tongue flange 30 and the base portion 24 substantially in parallel alignment with the wall surface.

The tongue flange 30 is preferably partially circular in shape. The tongue flange 30 can have corrugations 34 formed therein so as to lend additional thickness and strength to the flange. Another tongue flange 36 can be provided substantially opposite the tongue flange 30. The tongue flange 36 can be raised from an opposite side of the base portion 24 by a leg flange 40. The tongue flange 36 can also include corrugations 34 for additional thickness and strength.

The system of the invention can be used to trim a door and to install a door jamb without a need for tapered wood shims. A clip according to the invention would preferably include a center spacing portion 42 extending from the base portion 24. The center spacing portion 42 can be substantially planar and has door jamb engagement structure at an end distal to the base portion 24. The door jamb engagement structure preferably is a flange 46 that is substantially perpendicular to the center spacing portion, depending oppositely from the raised tongue flanges 30 and 36, and is adapted to engage a bore in the door jamb. The door jamb engagement flange preferably has saw tooth projections 50 to firmly engage the door jamb.

Additional structure for engaging the clip to a door jamb can be provided. An aperture 52 can be provided in the center spacing portion 42 and is adapted to receive suitable fastening structure such as a screw to firmly secure the clip to the door jamb.

A stop portion is preferably provided on the center spacing portion 42. The stop portion is adapted to abut a back face of the door jamb to provide rigidity and stiffness to the door jamb mounting. The stop portion preferably comprises a surface substantially perpendicular to the center spacing portion 42. The stop portion can be formed from laterally extended stop flanges 54 on the center spacing portion that are partially turned at right angles in the direction of the flange 46 to form the stop surfaces 56.

The attachment of a clip to a door jamb according to the invention is shown in FIGS. 7–10, wherein like numbers refer to like parts of the clip. A clip 20 is attached to a door jamb 60 having a back face 64 and a side face 68. A bore 72 is fashioned in the side face 64 of the jamb 60 and is adapted to receive the door jamb engagement flange 46. The saw teeth 50 firmly engage the door jamb 60 to secure the clip 20 to the door jamb 60. A channel 80 is preferably formed in the side face 68 of the door jamb 60 and extends from the bore 72 to the back face 64 and is adapted to receive the center spacing portion 42 of the clip 20. The channel 80 provides for a substantially flush surface between the top of the center spacing portion 42 and the side face 68 of the door jamb 60 when the clip 20 has been set in place.

Additional engagement structure such as the screw 84 can be used to secure the clip 20 to the door jamb 60. The screw 84 is adapted to fit the aperture 52 to securely fasten the clip 20 to the door jamb 60. The screw 84 is preferably of the flat-head design to retain the flush mounting between the surface of the center spacing portion 42 and the side face 68 of the door jamb 60.

The center spacing portion 42 is preferably substantially parallel to the base portion 24 and offset therefrom a distance substantially that of the thickness of base portion 24. This can be accomplished by a substantially S-shaped connection 86 between the base portion 24 and the center spacing portion 42. Hardwood trim engaged to the clip can thereby be substantially flush with the wall, which abuts the back face of the base portion 24, and with the front face of the center spacing portion 42 and thus the side face 68 of the door jamb 60.

The invention provides a method for conveniently erecting a door jamb with trim. A plurality of clips 20 are secured to the door jamb 60 as previously described. The door jamb 60 is preferably complete as a U-shaped structural assembly, to which the clips 20 are fixed at spaced intervals along the vertical sides of the U-shaped assembly. The U-shaped assembly is set in place within the door opening and plumbed with a level or other suitable apparatus. Screws 90 are driven thorough the aperture 26 in the base portion 24, through the wall surface such as plasterboard 94 if necessary, and preferably into a structural frame member such as the metal stud 98. The screws 90 can be driven into place by suitable automatic apparatus, or holes can be drilled at the properly marked locations for later attachment of the screws 90. Clips 20 can then be installed on the opposite side of the door frame. The trim is attached by interconnecting the tongue structure on the clips 20 to the undercut portion formed in the back face of the trim. The door jamb thus provided is quickly plumbed and mounted without the need for tapered wood shims and the like.

Figures 11, 12, 13, 14, 15:
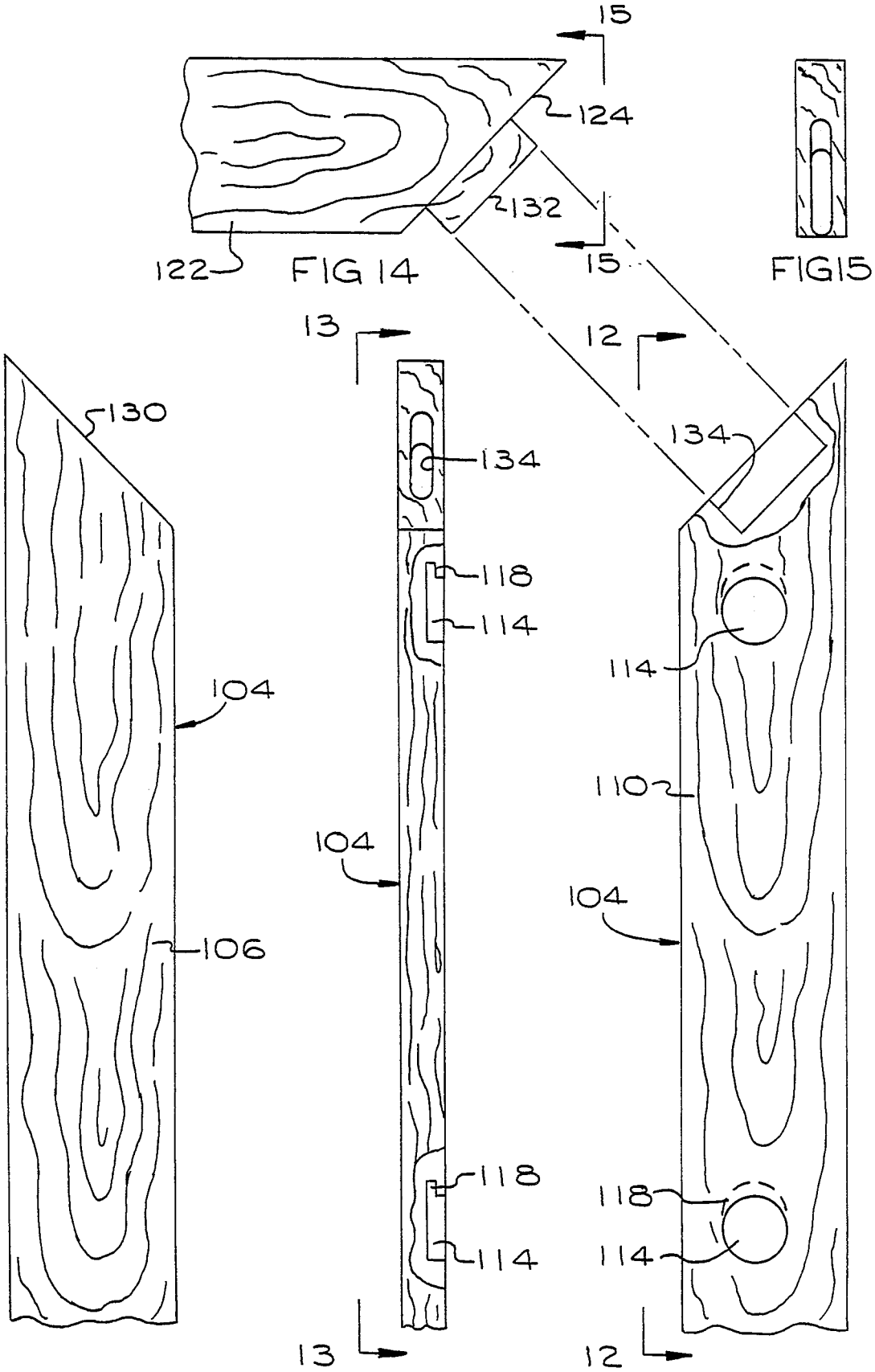
FIG. 11 is a rear elevation, partially in phantom and broken away, showing hardwood trim according to the invention.
FIG. 12 is a side elevation, partially broken away, taken along line 12—12 in FIG. 11.
FIG. 13 is a front elevation taken along line 13—13 in FIG. 12.
FIG. 14 is a front elevation of a cross trim member of a door trim assembly according to the invention.
FIG. 15 is a side elevation taken along line 15—15 in FIG. 14.
Figure 17:
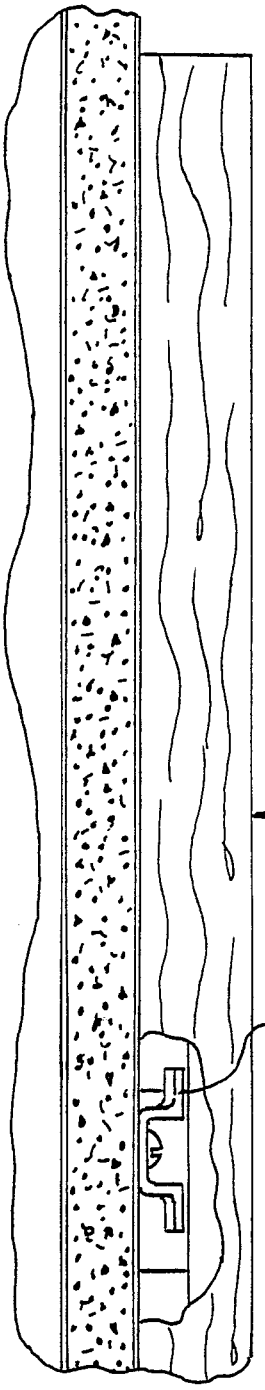
FIG. 17 is a cross-section, partially broken away, taken along line 17—17 in FIG. 16.
Figure 16:
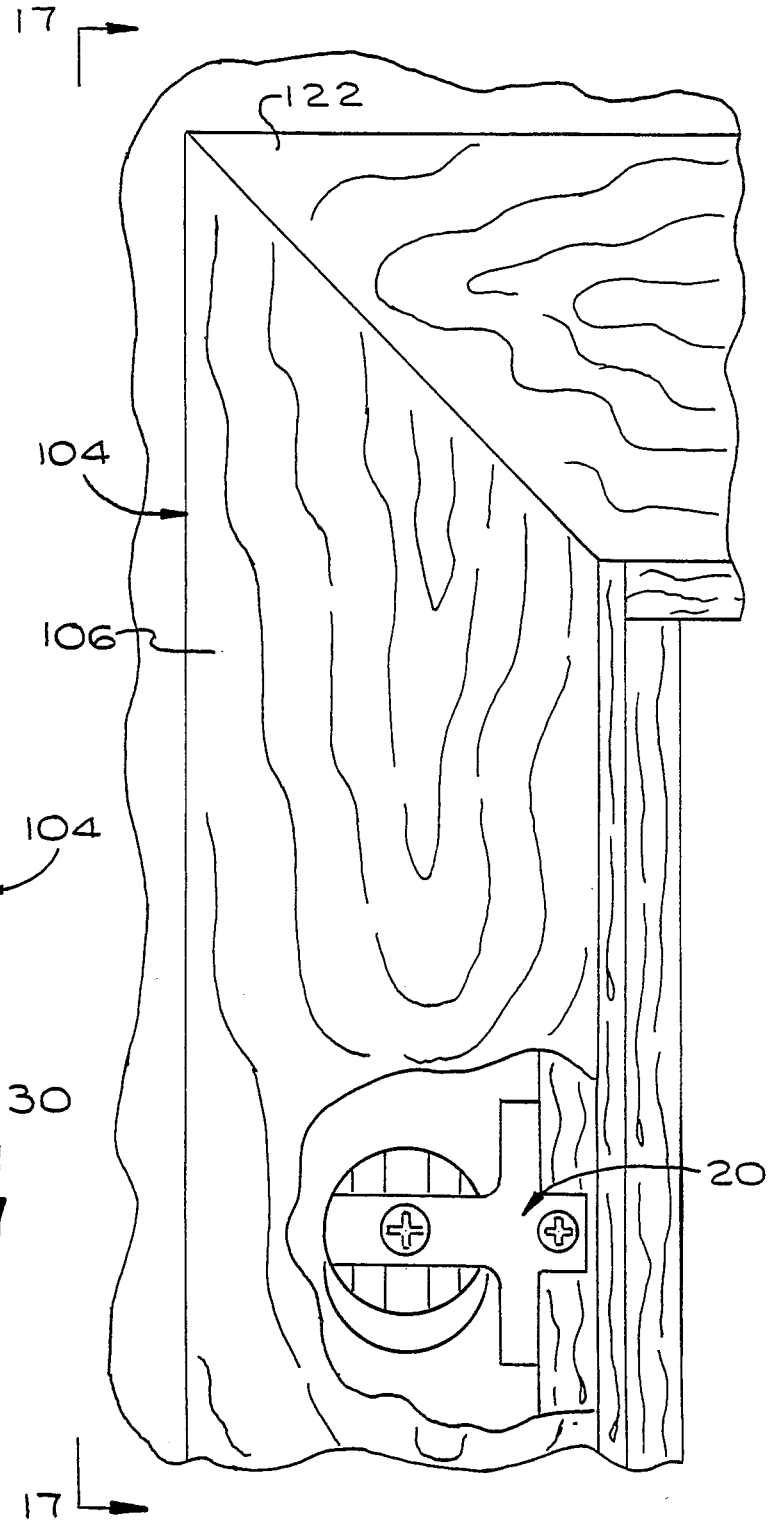
FIG. 16 is a front elevation, partially broken away, showing a completed door jamb and trim assembly according to the invention.

Hardwood trim according to the invention is shown in FIGS. 11–13. A piece of trim 104 has a front face 106 and a rear face 110. The rear face 110 of the hardwood trim 104 includes undercut structure adapted to receive the tongue structure of the clips 20. The undercut structure is preferably formed from a bore 114. The bore 114 is preferably formed to closely exceed the perimeter of the tongue structure of the clip 20. The bore 114 therefore substantially matches the substantially circular perimeter formed by the raised tongue flanges 30 and 40 of the clip 20. It would be apparent, however, that alternative designs of matching tongue and groove structure could be provided.

The depth of the bore 114 preferably matches the distance between the tongue flanges 30 and 40 and the distal face of the base portion 24. The rear face 110 of the trim member 104 when installed can then nest substantially coplanar with the distal face of the base portion 24 and thus the wall surface with which the base portion 24 is in contact.

A pocket structure is formed by undercutting a portion of the hardwood trim (phantom lines in FIG. 11) to form the pocket 118. Tongue flanges 30 or 40 interlock with the pocket 118 when the trim member 104 is slid toward the flanges in the direction of the arrow in FIG. 18. This simultaneously interlocks all of the pockets on that piece of trim with all of the tongue structure on the corresponding clips 20. The trim is held securely in place without the necessity of drilling holes through the visible front face 106. The natural beauty of the hardwood is thereby retained.

The trim about the top of the door can be completed as shown in FIGS. 14–15. A cross trim member 122 has a bevelled edge 124 having an angle complementary to a bevelled edge 130 on the vertical trim member 104. A wooden tongue 132 is formed at the bevelled edge 124 of the cross trim member 122. The tongue 132 is adapted to interconnect with a groove 134 fashioned into the bevelled edge 130 of the trim member 104. The tongue 132 and groove 134 form a snug and integral joint which can be formed after the vertical legs of the door trim have been set in place.

This invention can be embodied in other forms without departing from the spirit or essential attributes thereof and, accordingly, reference should be made to the following claims, rather than to the foregoing specification, as indicating the scope of the invention.

I claim:

1. A system for installing wood door jambs and wood trim comprising, in combination:

a clip having a base portion adapted to abut a wall surface, the base portion having an aperture adapted to receive fastening structure therethrough for engaging said clip to wall structure, structure for engaging a piece of hardwood trim comprising tongue structure, said tongue structure comprising at least one tongue flange, the tongue flange being substantially parallel to the base portion and being raised from and fixed to said base portion by leg flange means, and structure for engaging a door jamb; and, at least one piece of trim, the trim having a front face and a back face, the back face of the trim having engagement structure comprising undercut structure adapted to engage the tongue flange on said clip, whereby the trim is firmly fixed to the clip and to the wall structure without the need to drill holes through the visible front face of the trim, and the door jamb is fixed to said clips and to said wall structure.

2. The system of claim 1, wherein a tongue flange is provided on each of opposing sides of the base portion.

3. The system of claim 2, wherein each tongue flange is substantially half-circular in shape.

4. The system of claim 2, wherein the tongue flange is corrugated for additional thickness and strength.

5. The system of claim 1, wherein the undercut structure forms a pocket in said wood trim adapted to slidably receive said tongue structure.

6. The system of claim 1, wherein said at least one clip further comprises a center spacing portion extending from said base portion, the door jamb engagement structure being substantially at an end of the center spacing portion distal to the base portion.

7. The system of claim 6, wherein the door jamb engagement structure comprises a door jamb engagement flange adapted to engage a bore in a door jamb member.

8. The system of claim 7, further comprising fastening structure in said center spacing portion for engaging said center spacing portion to said door jamb member.

9. The system of claim 8, wherein said fastening structure includes at least one aperture in said center spacing portion adapted to receive a fastening member.

10. The system of claim 8, wherein said door jamb engagement flange comprises at least one projection adapted to grip said door jamb engagement member.

11. The system of claim 7, wherein said door jamb member further comprises a channel between said bore and a back face of said door jamb member, the channel being adapted to receive said center spacing portion to provide a flush surface between a side face of said door jamb member and the top surface of said center spacing portion.

12. The system of claim 6, comprising stop means for abutting a back surface of said door jamb member.

13. The system of claim 12, wherein said stop means comprise laterally extending flanges from said center spacing portion, said lateral flanges being turned down at substantially right angles to said lateral flanges in the direction of said door jamb engagement flange and to said center spacing portion to form stop flanges, said stop flanges being adapted to nest snugly against a back surface of said door jamb member.

14. The system of claim 5, wherein said hardwood trim comprises vertical door trim members and cross door trim members, said cross trim members having bevelled ends adapted to cooperate with bevelled ends on said vertical door trim members, said bevelled ends of said door trim members and door cross trim members having cooperating tongue and groove structure to engage said door cross trim members to said door vertical leg trim members.

15. A system for installing wood door jambs and wood trim comprising, in combination:

a clip having structure for engaging wall structure, structure for engaging a piece of wood trim, and structure for engaging a door jamb, said structure for engaging the trim comprising tongue structure;

at least one piece of wood trim, the wood trim having a front face and a back face, the back face of the wood trim having undercut engagement structure, the tongue structure being adapted to cooperate with the undercut structure formed in the back face of the at least one piece of trim so as to substantially prohibit movement of said wood trim in a direction normal to said wall structure, whereby the wood trim is firmly fixed to the clips and to the wall structure without the need to drill holes through the front face of the wood trim, and the door jamb is fixed to said clips and to said wall structure.

16. The system of claim 15, wherein the clip comprises a base portion, the base portion being adapted to abut a wall surface and having thereon said structure for engaging wall structure.

17. The system of claim 16, wherein the door jamb engagement structure comprises a door jamb engagement flange adapted to engage a bore in a door jamb member.

* * * * *